United States Patent [19]

Yanagisawa et al.

[11] 4,191,870

[45] Mar. 4, 1980

[54] PRESSURE RESPONSIVE SWITCH HAVING PROTECTION FROM OVERPRESSURE OF SOURCE

[75] Inventors: Syozo Yanagisawa, Tokaimura; Shigewo Ishikawa, Katsuta, both of Japan

[73] Assignee: Hitachi, Ltd., Japan

[21] Appl. No.: 958,559

[22] Filed: Nov. 7, 1978

[30] Foreign Application Priority Data

Nov. 7, 1977 [JP] Japan ..... 52-132500

[51] Int. Cl.[2] ..... H01H 35/34

[52] U.S. Cl. ..... 200/83 P; 200/81 R; 200/83 Q; 91/436

[58] Field of Search ..... 137/854; 92/7; 91/436, 91/422, 442, 28; 340/52 R, 52 B, 52 C, 626, 669; 200/34, 81 R, 82 R, 82 D, 83 R, 83 A, 83 B, 83 T, 83 J, 83 N, 83 P, 83 Q, 83 W

[56] References Cited

U.S. PATENT DOCUMENTS

| | | | |
|---|---|---|---|
| 2,704,551 | 3/1955 | Ralston | 200/83 P |
| 3,005,888 | 10/1961 | Putz | 200/83 Q |
| 3,413,894 | 12/1968 | Kress | 91/436 |
| 3,810,141 | 5/1974 | Pferd | 200/83 B |

*Primary Examiner*—Gerald P. Tolin

*Attorney, Agent, or Firm*—Craig and Antonelli

[57] ABSTRACT

A valve seatis mounted within a housing. An actuating shaft movable in the axial direction is rigidly fixed to center portions of an elastic valve and snap-action plate. The elastic valve has an outer resilient peripheral portion press-fitted to the valve seat by it's elasticity and separates the interior of the housing into a low and a high pressure chamber. The snap-action plate responds to the movement of the actuating shaft and rapidly changes a pair of contacts responsive to the movement of the actuating shaft from one position to the other position. The low pressure chamber is connected to an intake manifold of a combustion engine and high pressure chamber is opened to the atmosphere. When the overpressure is produced in the low pressure chamber, the peripheral portion of the elastic valve separates from the valve seat and performs protection.

4 Claims, 1 Drawing Figure

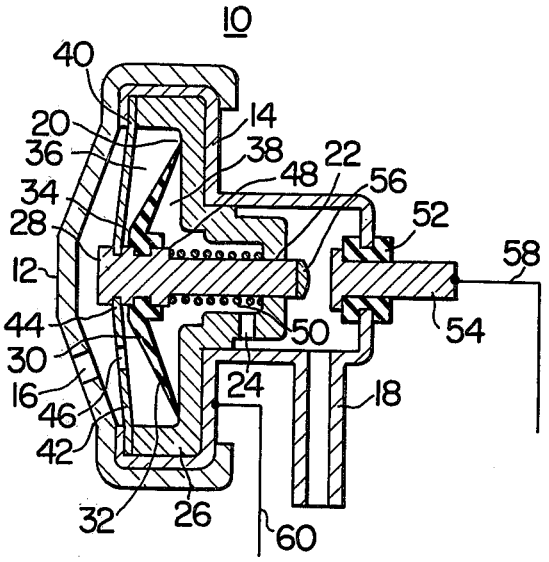
10
40
20
36
34
28
12
44
30
16
46
42
32
26
14
38
48
22
56
52
58
54
50
24
18
60

PRESSURE RESPONSIVE SWITCH HAVING PROTECTION FROM OVERPRESSURE OF SOURCE

BACKGROUND OF THE INVENTION

The present invention relates to a pressure responsive switch or more in particular to a pressure responsive switch having a protection from overpressure of a pressure source, suitable for responding to an intake manifold vacuum and an exhaust gas pressure.

A pressure switch comprising a combination of a diaphragm adapted to be displaced in accordance with pressure and a switch turned on and off in accordance with the displacement of the diaphragm is well known. The pressure switch is used for controlling an internal combustion engine of an automobile by detecting the intake manifold vacuum and exhaust gas pressure of the engine. Such a system is described in U.S. Pat. No. 2,957,463 entitled "Fuel Cut-Off for Carburetor Equipped Engine" and issued to Julius W. Schnabel on Oct. 25, 1960. In the cited system, when a backfire occurs, an excessive shock pressure is applied to the pressure switch, and the diaphragm is likely to be torn or extended to such a degree as to be deformed, thus making the system inoperative or deteriorating the characteristics thereof.

SUMMARY OF THE INVENTION

An object of the present invention is to provide a pressure switch which is not made inoperative or deteriorated in characteristics even under an excessive shock pressure caused in a pressure source.

Another object of the present invention is to provide a pressure switch of simple structure not using a microswitch.

The feature of the present invention lies in that an actuating shaft axially movably extended in the housing carries a pressure responsive wall and a snap-action plate for quickening the opening and closing of contacts. Under normal conditions, the pressure responsive wall is press-fitted to the valve seat to function the same way as a diaphragm, while under abnormal conditions, it is removed from the valve seat for protection of the system. The pressure responsive wall is configured to be subjected to a differential pressure. In the case where the intake manifold vacuum is introduced to the low pressure side, for example, the high pressure side thereof is communicated with atmosphere. When the exhaust gas pressure is introduced to the high pressure side, on the other hand, the low pressure side is communicated with atmosphere. The actuating shaft is operated to open or close the contacts and may be so configured that when pressure exceeds a predetermined level, the contacts are changed from open position to closed position or from closed position to open position.

BRIEF DESCRIPTION OF THE DRAWING

The single FIGURE is a side elevational view showing a preferred embodiment of the present invention.

DESCRIPTION OF THE PREFERRED EMBODIMENT

In the FIGURE, a housing 10 includes a pair of covers 12 and 14 secured to each other at the peripheral portions of the opening thereof. The cover 12 has an aperture 16 by which the inside of the cover 12 communicates with atmosphere, while the cover 14 has a pipe

18 for introducing the intake manifold vacuum of the internal combustion engine (not shown). Further, a support 26 having a valve seat portion 20, a guide 22 and an aperture 24 is secured to the inside of the housing 10. An actuating shaft 28 is mounted in the housing 10 movably in the axial direction. The pressure responsive wall 30 has an outer resilient peripheral portion 32 press-fitted by elasticity thereof to the valve seat 20. The central portion 34 thereof is rigidly fixed to the actuating shaft 28. As a result, a high pressure chamber 36 and a low pressure chamber 38 opposite to the high pressure chamber 36 with respect to the pressure responsive wall 30 are formed within the housing 10. As described above, the intake manifold vacuum and atmosphere are introduced into the low pressure chamber 38 and the high pressure chamber 36 respectively, and therefore a differential pressure is caused on both sides of the pressure responsive wall 30. Thus the actuating shaft 28 secured to the central portion 34 of the wall 30 is axially displaced in accordance with the vacuum of the intake manifold.

The central portion 44 of the snap-action plate 42 the outer periphery portion 40 of which is rigidly secured to the inner periphery portion of the housing 10 is rigidly fixed to the actuating shaft 28. Thus the actuating shaft 28 is movably mounted in the housing 10 by the snap-action plate 42 and the guide 22. The snap-action plate 42 has an aperture 46, which, in cooperation with the aperture 16, opens the high pressure chamber 36 to atmosphere.

A spring 50 is mounted between a support 36 and a flange 48 formed on the actuating shaft 28. The pressure P1 of the spring 50 is determined at a larger value than the pressure P2 of the snap-action plate 42. Therefore, when the vacuum of intake manifold exceeds P1+P2, the actuating shaft 28 rapidly moves rightward; and when it is reduced below P1−P2, the actuating shaft 28 rapidly moves leftward and returns to the shown position. The fixed contact 54 secured to the cover 14 through an insulating bushing 52 is opposed to the movable contact 56 formed at an end of the actuating shaft 28. This pair of contacts are closed and opened in response to the axial movement of the actuating shaft 28. Wires 58 and 60 leading to the fixed contact 54 and the movable contact 56 respectively are connected to control means not shown respectively.

In the above-described configuration, assume that the actuating shaft 28 is initially returned to the condition shown in the drawing. When the vacuum of the intake manifold is lower than the predetermined pressure $P_{ON}$ (=P1+P2), the actuating shaft 28 is urged leftward, thereby opening the contacts 54 and 56 as shown, by the action of the snap-action plate 42 and the spring 50 inserted between the support 26 and the flange 48 of the actuating shaft 28. With the increase in the vacuum of the intake manifold, an increasing force works to displace the actuating shaft 28 rightward against the force of the spring 50 and the snap-action plate 42, but not to such a degree as to reverse the snap-action plate 42. When the vacuum of the intake manifold reaches the predetermined pressure $P_{ON}$, the snap-action plate 42 is reversed by the well-known principle of snap action, thereby rapidly displacing the actuating shaft 28 rightward against the pressure P1 of the spring 50. The contacts 54 and 56 thus far open are rapidly closed, and current flows in the wires 58 and 60, so that the predetermined pressure $P_{ON}$ is detected as an electrical signal.

After reversal of the snap-action plate 42, the pressure P2 in reverse direction works, thus keeping the contacts 54 and 56 closed. If the vacuum of the intake manifold is reduced below the predetermined pressure $P_{ON}$, therefore, the contacts 54 and 56 fail to open immediately.

When the vacuum of the intake manifold exceeds the predetermined pressure $P_{OFF}(=P1-P2)$, the actuating shaft 28 is forced back by the spring 50 and the snap-action plate 42 is rapidly reversed, thus opening the contacts 54 and 56. The closing pressure $P_{ON}$ and the opening pressure $P_{OFF}$ of the contacts 54 and 56 are thus different, showing the hysteretic characteristic of the operation of the contacts 54 and 56.

In the case where backfire in the internal combustion engine of the automobile causes a shock over-pressure to be applied to the low pressure chamber 38, the peripheral portion 32 of the pressure responsive wall 30 is moved off from the valve seat 20 to which it has thus far been press-fitted, so that the gas in the low pressure chamber 38 is instantaneously discharged into atmosphere through the apertures 46 and 16. As a result, the over-pressure acting on the pressure responsive wall 30 and the snap-action plate 42 is lost instantaneously, thus preventing any damage or deformation thereof.

We claim:

1. A pressure responsive switch having a protection, from overpressure of a pressure source comprising:

a housing having a valve seat thereon;

a pressure responsive wall having an outer resilient peripheral portion press-fitted to said valve seat by elasticity thereof, and for forming a chamber together with said housing;

an actuating shaft rigidly fixed to the center portion of said pressure responsive wall and movable in the axial direction thereof;

a pair of contacts, the closing and opening of which are in response to the axial movement of said actuating shaft;

a snap-action plate connected to said actuating shaft and said housing for responding to the movement of said actuating shaft and changing rapidly said contacts from one position to the other position; and means for applying pressure to the chamber formed of said pressure responsive wall and said housing, whereby differential pressure is produced between both sides of said pressure responsive wall and said actuating shaft moves in response to the pressure from the pressure source; and wherein the outer periphery of said pressure responsive wall lifts off said valve seat when overpressure is produced in said chamber.

2. A pressure responsive switch having a protection from overpressure of a pressure source as claimed in claim 1, in which another chamber is formed opposite to said chamber with respect to said pressure responsive wall, and one chamber is connected to the pressure source and the other chamber is opened to the atmosphere.

3. A pressure responsive switch having a protection from overpressure of a pressure source as claimed in claim 2, in which the outer peripheral portion of said snap-action plate is fixed to the inside wall of said housing to mount said actuating shaft movable in the axial direction within said housing.

4. A pressure responsive switch having a protection from overpressure of a pressure source as claimed in claim 2, which further comprises:

a spring inserted between said actuating shaft and said housing for biasing said actuating shaft in an axial direction and holding said contacts at a predetermined position until the pressure from the pressure source reaches a predetermined pressure.

* * * * *